United States Patent [19]

Bradley

[11] Patent Number: 4,934,452

[45] **Date of Patent: * Jun. 19, 1990**

[54] SUB-SURFACE RELEASE PLUG ASSEMBLY

[75] Inventor: Billie J. Bradley, Duncan, Okla.

[73] Assignee: Halliburton Company, Duncan, Okla.

[ * ] Notice: The portion of the term of this patent subsequent to Mar. 7, 2006 has been disclaimed.

[21] Appl. No.: 277,654

[22] Filed: Nov. 25, 1988

Related U.S. Application Data

[63] Continuation of Ser. No. 93,430, Sep. 4, 1987, Pat. No. 4,809,776.

[51] Int. Cl.[5] ..... E21B 33/16

[52] U.S. Cl. ..... 166/153; 166/155; 166/291

[58] Field of Search ..... 166/291, 153, 154, 155, 166/156, 192, 242

[56] References Cited

U.S. PATENT DOCUMENTS

| | | | |
|---|---|---|---|
| 3,006,415 | 10/1961 | Burns et al. | 166/156 |
| 3,228,473 | 1/1966 | Baker | 166/154 |
| 3,247,905 | 4/1966 | Baker | 166/194 |
| 3,545,542 | 12/1970 | Scott | 166/155 |
| 3,605,896 | 9/1971 | Perkins | 166/290 |
| 3,635,288 | 1/1972 | Lebourg | 166/156 |
| 3,768,562 | 10/1973 | Baker | 166/289 |
| 3,796,260 | 3/1974 | Bradley | 166/153 |
| 4,624,312 | 11/1986 | McMullin | 166/155 |
| 4,671,358 | 6/1987 | Lindsey, Jr. et al. | 166/291 |
| 4,809,776 | 3/1989 | Bradley | 166/153 |

*Primary Examiner*—William P. Neuder

*Attorney, Agent, or Firm*—James R. Duzan; Neal R. Kennedy

[57] ABSTRACT

A sub-surface release plug assembly for use in cementing an outer casing annulus around a well casing. The assembly includes a top plug releasably connected to a drill string by a collet mechanism and including a swivel connector and a vent thereabove. A sleeve assembly extends through the top plug, and a bottom plug is releasably attached thereto. A vent is provided in the sleeve assembly between the top and bottom plugs, and this vent may be closed prior to releasing the bottom plug. The construction of the inner sleeve assembly provides that no high pressure from the drill string is applied to inner portions of either the top or bottom plugs. Thus, the plugs may be made of relatively soft, easily drillable material, even including plastic. When the lower plug is released and pumped to the bottom of the well casing, additional pressure opens a valve so that a flow passageway is provided therethrough. A slidable, sealing sleeve prevents fluid in the drill string from being in contact with the collet mechanism prior to releasing the top plug.

19 Claims, 4 Drawing Sheets

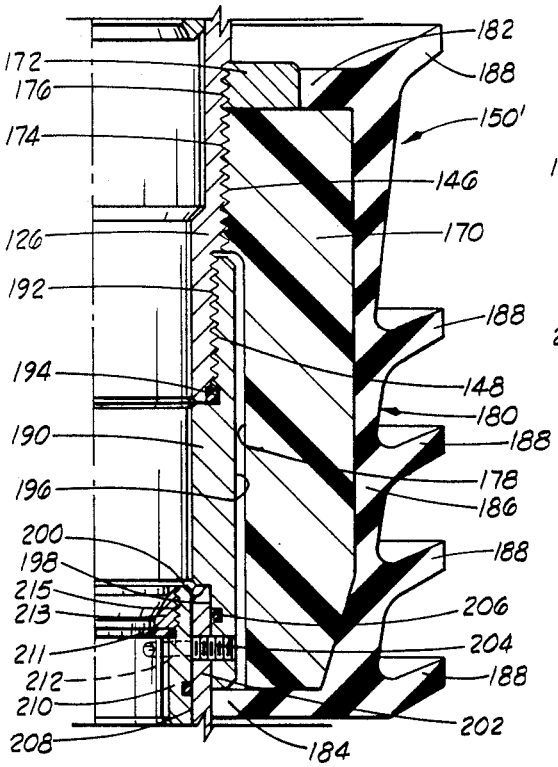
FIG. 4
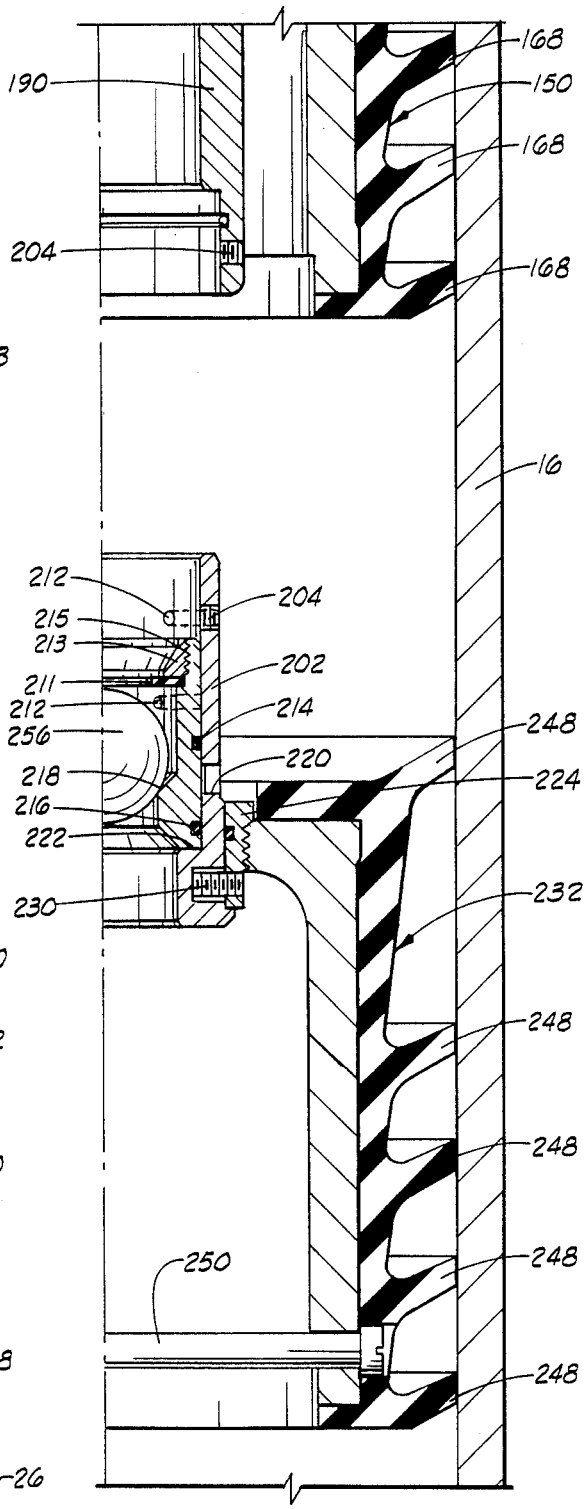
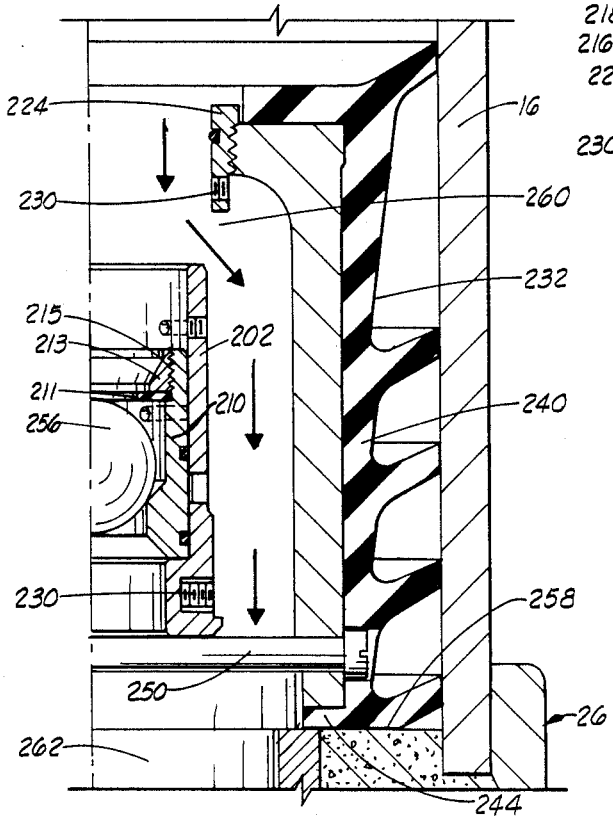
FIG. 5

SUB-SURFACE RELEASE PLUG ASSEMBLY

This is a continuation of application Ser. No. 093,430, filed Sept. 4, 1987 now Pat. No. 4,809,776.

BACKGROUND OF THE INVENTION

1. Field of the Invention

This invention relates to sub-surface release plugs used in cementing of the outer casing annulus of a well bore, and more particularly, to a sub-surface release plug having a sealed collet release mechanism, venting between upper and lower plugs and having an inner sleeve such that pressurization of the well string is not applied to the plugs themselves.

2. Description of the Prior Art

Sub-surface release plugs positioned in the upper portion of a well casing below a casing hanger and attached to the lower end of a drill string are commonly used in cementing operations for cementing a casing annulus adjacent a shoe joint. Typically, a bottom plug of the assembly is released and cement is pumped into the casing above the bottom plug, forcing the bottom plug downwardly until it comes to rest at the upper end of the shoe joint. The bottom plug seals against the inner surface of the casing so that mud below the bottom plug and cement above the bottom plug are not mixed. Once the bottom plug has reached its lowermost position, the bottom plug is opened to allow cement to pass therethrough. The cement then passes through a float collar and/or float shoe and an opening at the lower end of the shoe joint into the casing annulus. A valve in the float collar and/or float shoe prevents reverse movement of the cement through the casing.

When the proper amount of cement has been introduced into the casing and drill string, a releasing dart or drill pipe plug is dropped into the drill string. The releasing dart engages a latching mechanism above the top plug, thus closing off the central opening of the top plug and releasing it from the drill string. The fluid pumped into the drill string forces the top plug, and the dart or drill pipe plug latched thereto, down toward the bottom plug, forcing the cement through the shoe joint.

The top plug stops when it contacts the bottom plug. Once the cement has set, the top and bottom plugs are drilled out of the casing.

One such prior art sub-surface release plug system is disclosed in Halliburton Services Sales and Service Catalog 43, pages 2424–2426.

One problem with the previous system is that when the ball is dropped to release the bottom plug, high pressure is exerted on the inner surfaces of the plugs. This release pressure can burst the top and bottom plug inserts if special materials of construction are not used. Such materials, such as heat-treated aluminum alloys, provide a much stronger plug, but the increased strength results in a harder, tougher alloy which is more difficult to drill out later. The sub-surface release plug assembly of the present invention provides an inner sleeve means against which the pressure is applied such that not pressure is exerted on the inside of either the top or bottom plugs. Thus, the plugs can be made of lower strength, softer aluminum alloys or even partially made of plastic. This results in a plug assembly which is much easier to drill out after the cementing operation.

Another problem with the prior art apparatus is that a complex double collet mechanism is used which is relatively expensive to manufacture. Also, a portion of the collet mechanism is exposed to the cement and possible may become clogged during the cementing operation which will make it impossible to release the top plug. The present invention uses a single collet mechanism which is sealingly separated from the fluids in the drill string until immediately prior to releasing of the top plug.

Still another problem with the previous system is that it is difficult or impossible to assemble in the field. The design of the present invention is constructed such that the two plugs are easily assembled by simple threaded engagement. This also allows the present invention to be easily adapted to situations where only one plug is desired.

A further problem with the sub-surface release plug assembly of the prior art is that no venting is provided between the plugs because it was necessary for the assembly to withstand pressure on the inside thereof. The present invention provides vent means between the plugs and above the top plug which prevents premature release of the bottom plug and inversion of the sealing lips on the top and bottom plugs.

As indicated, it is sometimes desired to have only one plug rather than the two-plug design. In such cases, the single plug acts in substantially the same manner as the top plug described herein. The present invention which is easily assembled or disassembled provides an apparatus which is quickly adaptable to either a one or two plug configuration.

SUMMARY OF THE INVENTION

The sub-surface release plug assembly of the present invention is adapted for use in a well casing and comprises upper plug means sealingly engageable with an inner surface of the wall casing and releasably attachable to a drill string, lower plug means sealingly engageable with the inner surface of the well casing and releasably attached to the upper plug means, and vent means for providing venting between the drill string and the well casing at a position longitudinally between the upper and lower plug means. The apparatus further comprises releasing means for releasing the lower plug means from the upper plug means in response to a first pressure in the drill string, and collet releasing means for releasably connecting the upper plug means to the drill string and releasing the upper plug means in response to a second pressure.

The apparatus also preferably comprises second vent means for providing venting between the drill string and the well casing at a position above the upper plug means. Check valve means are disposed across the second vent means whereby venting is allowed from the well casing to the drill string while preventing venting from the drill string to the well casing.

Swivel means above the upper plug means are provided for allowing relative rotation of the drill string with respect to the plug means. Without the swivel means, the drill string could be unscrewed from the plug means when the casing hanger is made up prior to running in the well. Normally, the upper plug means is stationary with respect to the well casing and the drill string.

Sealing means are provided for sealingly separating the collet releasing means from fluid in the drill string prior to releasing the upper plug means. This prevent the possibility of cement or other foreign material interferring with proper actuation of collet fingers in the collet releasing means.

In the preferred embodiment, an inner sleeve means is attached to the upper plug means and extends longitudinally therethrough, and the lower plug means is releasably connected to the inner sleeve means by shear means. Sealing means insures that pressure in the drill string and inner sleeve means is not communicated or applied to inner portions of the upper and lower plug means. The vent means between the upper and lower plug means is disposed through the inner sleeve means, and slidable valve means are provided for closing the vent means in response to the first pressure prior to releasing the lower plug means.

The lower plug means comprises valve means therein for opening a flow passageway therethrough when the lower plug means reaches the bottom of the well casing.

A simple threaded connection provides engagement between the lower plug means and the inner sleeve means for quick assembly and disassembly in the field. Thus, the apparatus can be quickly converted to a single plug means configuration when desired.

An important object of the invention is to provide a sub-surface release apparatus with upper and lower plug means and vent means for providing venting between the upper and lower plug means.

Another object of the invention is to provide a sub-surface release apparatus with plug means and collect releasing means for releasably attaching the plug means to the lower end of the drill string wherein sealing means are provided for sealingly separating the collet releasing means from fluid in the drill string prior to releasing the plug means.

Still another object of the invention is to provide a sub-surface release plug with a top plug having inner sleeve means extending therethrough and a bottom plug releasably attached to the inner sleeve means.

A further object of the invention is to provide a sub-surface release plug assembly wherein pressure used to release plugs is not exerted on inner portions of the plugs themselves.

Additional objects and advantages of the invention will become apparent as the following detailed description of the preferred embodiment is read in conjunction with the drawings which illustrate such preferred embodiment.

BRIEF DESCRIPTION OF THE DRAWINGS

FIG. 4 is a longitudinal cross section of an alternate embodiment of the top plug of the sub-surface release plug assembly.

FIG. 5 is a longitudinal cross section showing the lower plug immediately after being released from the top plug.

FIG. 6 illustrates a longitudinal cross section of the lower plug at the bottom of the well casing and with a flow valve therein in an open position.

DESCRIPTION OF THE PREFERRED EMBODIMENT

Figure 1:
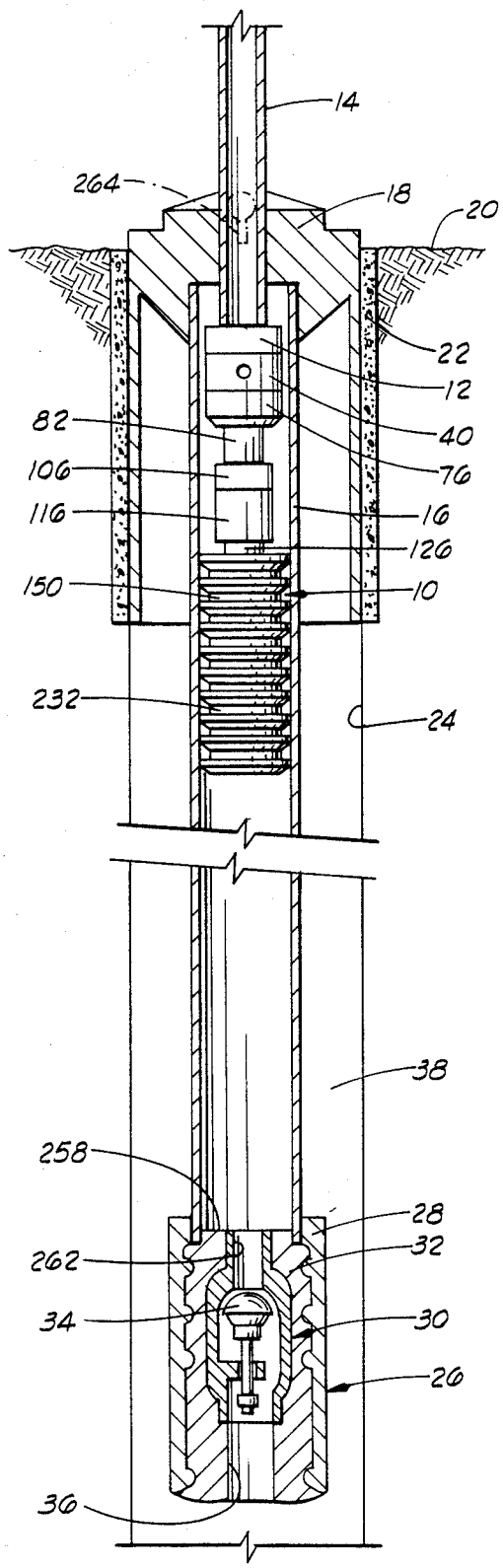
FIG. 1 shows the sub-surface release plug assembly of the present invention installed in its initial position in a well casing.

Referring now to the drawings, and more particularly to FIG. 1, the sub-surface release plug assembly of the present invention is shown and generally designated by the numeral 10. Sub-surface release plug assembly 10 has an upper adapter 12, connectable to the lower end of a drill string 14, and is positioned in a well casing 16. Well casing 16 is supported by a casing hanger or subsea well head 18 at sea floor 20. An annular concrete foundation 22 holds casing hanger 18 in place in well bore 24.

Typically attached to the lower end of well casing 16 is a float shoe 26. Float shoe 26 has an outer sleeve 28 and a check valve assembly 30 held in place by a cement portion 32. Check valve assembly 30 includes a back pressure valve 34 therein.

Float shoe 26 defines a lower opening 36 therein which opens into outer casing annulus 38 between well casing 16 and well bore 24.

Float shoe 26 is of a kind known in the art, and in one alternate embodiment also known in the art, a float collar or other similar device at the upper end of a shoe joint could be used. In still another embodiment, a guide shoe having a free flow, fully open and substantially unobstructed central opening therethrough with no float collar assembly 30 could be used. Sub-surface release plug assembly 10 may be used with any of these devices, and the invention is not intended to be limited for use with the float shoe illustrated.

Figure 2A:
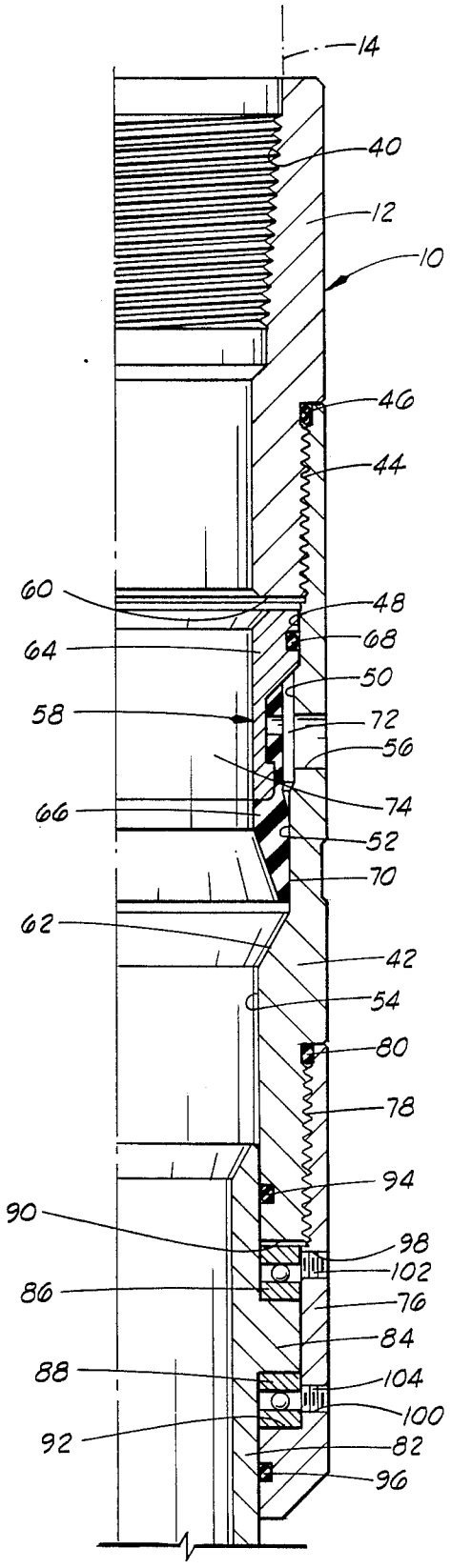
FIGS. 2A–2C show a longitudinal cross section of the sub-surface release plug in its initial position prior to release of any components thereof.
Figure 2B:
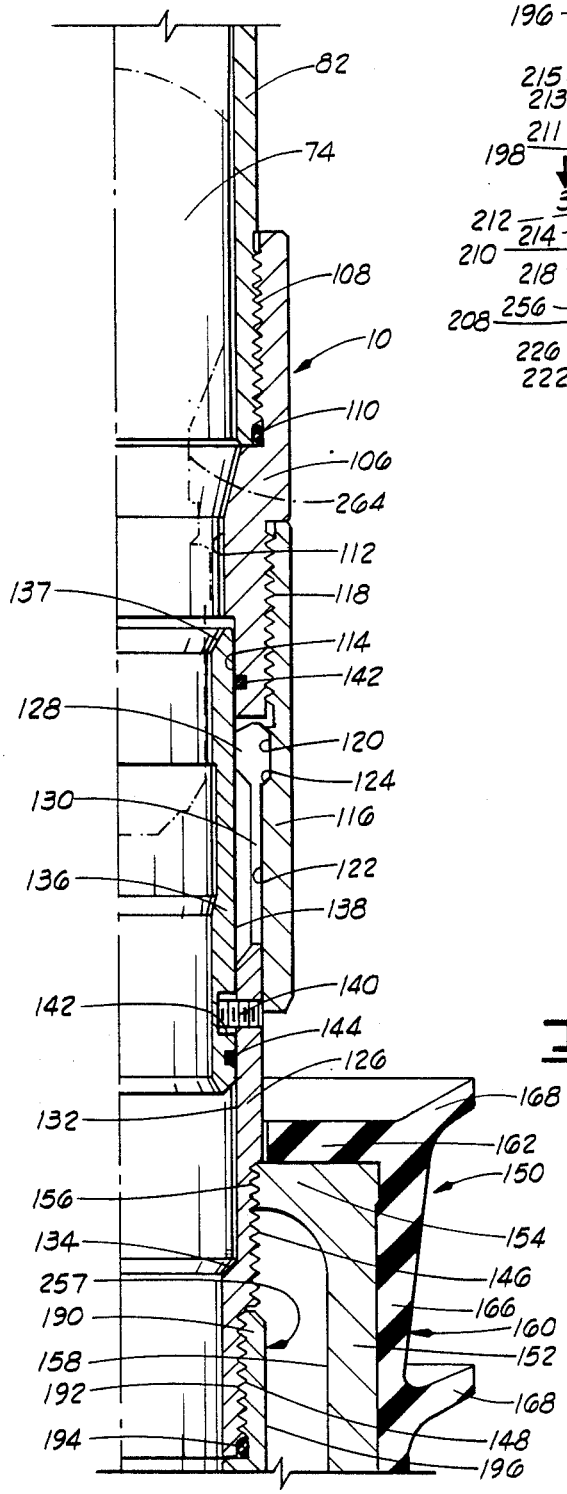
Figure 2C:
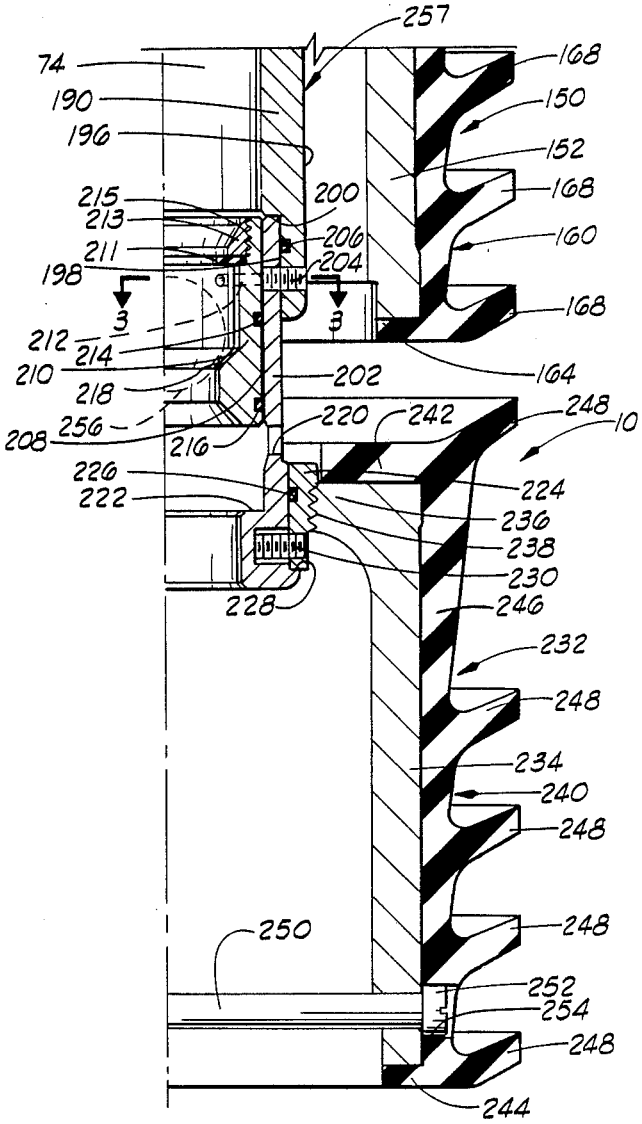

Referring now to FIGS. 2A–2C, details of sub-surface release plug assembly 10 will now be discussed. As shown in FIG. 2A, the upper end of upper adapter 12 has a threaded opening 40 therein adapted for attachment to drill string 14. The lower end of upper adapter 12 is connected to equalizer case 42 at threaded connection 44. Sealing means 46, such as an O-ring, provides sealing engagement between upper adapter 12 and equalizer case 42.

Equalizer case 42 defines a first bore 48, second bore 50, third bore 52 and fourth bore 54 therethrough. Equalizer case 42 also defines a transverse vent or equalizer opening 56 therethrough in communication with second bore 50.

A check valve means 58 is positioned in equalizer case 42 at a longitudinal location between lower end 60 of upper adapter 12 and chamfer 62 in equalizer case 42 between third bore 52 and fourth bore 54 thereof. Check valve means 58 includes a valve body 64 and a valve seal 66, made of an elastomeric material such as rubber. A sealing means 68, such as an O-ring, provides sealing engagement between valve body 64 and first bore 48 of equalizer case 42. A sealing lip 70 on valve seal 66 provides sealing engagement between the valve seal and third bore 52 of equalizer case 42. Thus, it will be seen that an annular volume 72 is defined between sealing means 58 and equalizer case 42 and is in communication with vent opening 56. It will also be seen that vent opening 56 is thus sealingly separated from central opening 74 through sub-surface release plug assembly 10. Thus, a vent means is provided wherein venting is allowed from well casing 16 to drill string 14 while venting from the drill string to the well casing is prevented.

The lower end of equalizer case 42 is attached to bearing housing 76 at threaded connection 78 with sealing means 80 providing sealing engagement therebetween.

Rotatably disposed within bearing housing 76 is the upper end of a swivel mandrel 82. Swivel mandrel 82 has a radially outwardly extending shoulder portion 84 thereon which is rotatably supported by upper ball bearing 86 and lower ball bearing 88 between lower end 900 of equalizer case 42 and upwardly facing shoulder 92 in bearing housing 76. Thus, assembly 10 includes swivel means for providing relative rotation between drill string 14 and the components below swivel mandrel 82.

Sealing means 94 provides sealing engagement between swivel mandrel 82 and fourth bore 54 of equalizer case 42 above bearings 86 and 88, and sealing means 96 provides sealing engagement between the swivel mandrel and bearing housing 76 below the bearings.

Bearing housing 76 defines a transverse hole 98 therethrough adjacent upper bearing 86 and a similar transverse hole 100 therethrough adjacent lower bearing 88. Holes 98 and 100 provide means for greasing bearings 86 and 88, respectively. Although holes 98 and 100 are shown in the same longitudinal plane in FIG. 2A, the holes are preferably angularly spaced 180° from one another. After greasing bearings 86 and 88, pipe plugs 102 and 104 are used to sealingly close holes 98 and 100, respectively.

Referring now to FIG. 2B, the lower end of swivel mandrel 82 is attached to the upper end of a lower connector 106 at threaded connection 108. Seal means 110 provides sealing engagement between swivel mandrel 82 and lower connector 106. Lower connector 106 defines a first bore 112 and a second bore 114 therethrough.

The lower end of lower connector 106 is connected to collet retainer 116 at threaded connection 118. Collet retainer 116 defines a first bore 120 and a second bore 122 therethrough with an annular, chamfered shoulder 124 therebetween.

The upper end of a collet 126 is disposed in collet retainer 116 below lower connector 106 such that the head portions 128 of a plurality of collet fingers 130 engage shoulder 124 in collet retainer 116.

Collet 126 defines a bore 132 therethrough and has a generally upwardly facing shoulder 134 at the lower end of bore 132.

A releasing sleeve 136 is slidably disposed in, and has an outer surface 138 in close spaced relationship with, second bore 114 of lower connector 106 and bore 132 of collet 126. It will also be seen that in the original position shown in FIG. 2B, releasing sleeve 136 keeps head portions 128 of collet fingers 130 engaged with shoulder 124 in collet retainer 116.

A shear means 140, such as a shear pin, is engaged with collet 126 and extends into a recess 142 in releasing sleeve 136, thus releasably holding the releasing sleeve in the original position shown in FIG. 2B.

Seal means 142 provides sealing engagement between lower connector 106 and the upper end of releasing sleeve 136 above collet fingers 130. Similarly, seal means 144 provides sealing engagement between bore 132 of collet 126 and releasing sleeve 136 below collet fingers 130. Thus, prior to actuation of releasing sleeve 136, means are provided for preventing communication between collet fingers 130 and central opening 74 of sub-surface release plug assembly 10. As will be more clearly seen hereinafter, this insures that cement and other fluids in drill string 14 do not interfere with the proper operation of collet fingers 130.

An intermediate portion of collet 126 as a first external thread 146 thereon, and the lower end of collet 126 has a second external thread 148 thereon. Preferably, second external thread 148 is smaller than first external thread 146.

A first or upper plug means 150, also referred to as a top plug means 150, is attached to collet 126 as shown in FIG. 2B, and, also referring to FIG. 2C, extends downwardly from the collet. Upper plug means 150 has a body or insert 152 with an upper, inwardly directed portion 154 which forms a threaded connection 156 with first external thread 146 of collet 126. Insert 152 has a generally cylindrical inside surface 158 below upper portion 154.

Insert 152 of upper plug means 150 is substantially surrounded by a jacket 160 bonded to the insert and preferably made of elastomeric material. Jacket 160 has an upper, inwardly directed portion 162 adjacent upper portion 154 of insert 152 and an inwardly directed lower portion 164 adjacent the lower end of insert 152. A generally longitudinal portion 166 of jacket 160 interconnects upper portion 162 and lower portion 164 thereof. Extending outwardly and angularly upwardly from longitudinal portion 166 are a plurality of wipers 168. As will be more fully explained herein, wipers 168 are adapted for sealingly engaging the inside surface of well casing 16.

In this first embodiment of the upper plug means, insert 152 is made of a relatively strong material, such as aluminum. Such material provides an adequate threaded connection 156 with external thread 146 of collet 126, and further provides adequate support for jacket 160.

Referring now to FIG. 4, an alternate first or upper plug means 150' is shown attached to collet 126. Alternate upper plug means 150' includes a body or insert 170, made of a lightweight material such as plastic, with a support ring 172, made of a stronger material, such as aluminum, positioned thereabove. Insert 170 forms a threaded connection 174 with external thread 146 of collet 126, and support ring 172 forms a threaded connection 176 with external thread 146. The lower end of insert 170 has a substantially cylindrical inside surface 178 which is smaller than inside surface 158 of insert 152 in the first embodiment.

As with the first embodiment, a jacket 180, preferably made of elastomeric material, substantially surrounds and is bonded to insert 170. Jacket 180 has an upper, inwardly directed portion 182 adjacent the upper end of insert 170 and the outside diameter of support ring 172. An inwardly directed, lower portion of jacket 180 is positioned adjacent the lower end of insert 170. A longitudinal portion 186 of jacket 180 extends between upper portion 182 and lower portion 184 thereof. As with the first embodiment, a plurality of wipers 188 extend angularly upwardly and outwardly from longitudinal portion 18. Again, wipers 188 are adapted for sealing engagement with the inside surface of well casing 16.

For either upper plug means 150 or 150', the lower end of collet 126 is attached to a collet connector 190 at threaded connection 192 formed with external thread 148 on collet 126. Sealing means 194 provides sealing engagement between collet 126 and collet connector 190. It will be seen that outer surface 196 is closer to inside diameter 178 of insert 170 in alternate upper plug means 150′ than inside surface 158 of insert 152 in first embodiment upper plug means 150.

Referring now to FIGS. 2C and 4, the lower end of collet connector 190 defines a bore 198 with a downwardly facing shoulder 200 adjacent thereto. Slidably positioned in bore 198 and adjacent shoulder 200 is a vent sleeve 202. Vent sleeve 202 is releasably attached to collet connector 190 by shear means 204, such as a shear pin. Seal means 206 provides sealing engagement between vent sleeve 202 and bore 198 in collet connector 190.

Figure 3:
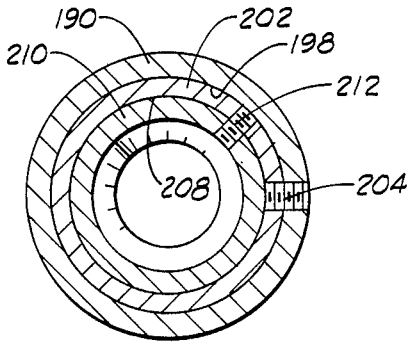
FIG. 3 is a transverse cross section taken along lines 3—3 in FIG. 2C.

Vent sleeve 202 defines an upwardly opening bore 208 in which is slidably positioned a vent valve means 210. As best shown in FIG. 3, vent valve means 210 is releasably attached to vent sleeve 202 by sheer means 212. Shear means 212 is angularly spaced from shear means 204. As shown in FIG. 3, the angular displacement is approximately 45°, but the angle is not at all critical.

An elastomeric, annular gasket 211 is disposed in the upper end of vent valve means 210 above shear means 212. Gasket 211 is held in place by ring 213 which is attached to vent valve means 210 at threaded connection 215.

Upper seal means 214 and lower seal means 216 provide sealing engagement between vent valve means 210 and bore 208 in vent sleeve 202. On the inside of vent valve means 210 is an angularly disposed, annular seat 218.

Vent sleeve 202 defines a vent means, such as transverse vent opening 220, therethrough in communication with bore 208 therein. When vent valve means 210 is in the initial position shown in FIG. 2C, vent opening 220 is below lower sealing means 216.

On the inside of the lower end of vent sleeve 202 is an upwardly facing annular shoulder 222 which limits downward movement of vent valve means 210 as in hereinafter described.

Slidably disposed around an enlarged lower end of vent sleeve 202 is a bushing 224. Seal means 226 provides sealing engagement between bushing 224 and vent sleeve 202. The lower end of bushing 224 is adjacent an upwardly facing outer shoulder 228 on vent sleeve 202. Shear means 230, such as a shear pin, provides releasable attachments between bushing 224 and vent sleeve 202.

Attached to bushing 224 is a second or lower plug means 232. Lower plug means 232 includes a body or insert 234 having an upper, inwardly directed portion 236 which is attached to bushing 224 at threaded connection 238.

Substantially surrounding and bonded to insert 234 is a closely fitting jacket 240, preferably made of elastomeric material. Jacket 240 has an upper, inwardly directed portion 242 adjacent upper portion 236 of insert 234 and an inwardly directed lower portion 244 adjacent the lower end of insert 234. A substantially longitudinal portion 246 of jacket 240 interconnects upper portion 242 and lower portion 244. Extending angularly upwardly and outwardly from longitudinal portion 246 are a plurality of flexible wipers 248. As will be discussed in greater detail herein, wipers 248 are adapted for sealing engagement with the inside of well casing 16.

Extending transversely through lower plug means 232, and preferably intersecting a longitudinal center line thereof, is a catcher bolt 250. At one end of catcher bolt 250 is a head 252 which is disposed in a hole 254 of jacket 240 and engages an outer surface of insert 234. Opposite head 252 is a threaded end (not shown) of catcher bolt 250 which engages a threaded opening in the opposite side (also not shown) of insert 234.

It will be seen that assembling sub-surface release plug assembly 10 into either a single plug or two plug configuration is a simple matter. The upper end of assembly 10 includes the collet mechanism and upper plug means 150 or 150′ connected thereto. A subassembly including lower plug means 232, bushing 224, vent sleeve 202, vent valve means 210 and collet connector 190 is easily attached and detached from upper plug means 150 by making and breaking threaded connection 192. Thus, field conversion is easy and no special assembly techniques are required. The prior art sub-surface release plug already described herein requires shear pin connection at all points, and thus it is extremely difficult to modify or assemble in the field. In other words, means are provided in the present invention for quickly separating lower plug means 232 from upper plug means 150 or 150′ in the field.

OPERATION OF THE INVENTION

Sub-surface release plug assembly 10 is shown in its original position in FIG. 1. Once it is desired to begin the operation for cementing outer casing annulus 38, a ball 256 is pumped down drill string 14 in a manner known in the art. Ball 256 comes to rest on seat 218 of vent valve means 210, as shown in FIG. 2C.

The inside diameter of gasket 211 is smaller than the diameter of ball 256, but gasket 211 will deflect downwardly and outwardly enough such that ball 256 will pass by the gasket. The inside diameter of ring 213 is only slightly larger than ball 256 and provides upward support for gasket 211. In this way, gasket 211 and ring 213 provide a means for preventing upward movement of ball 256 therepast. This insures that ball 256 remains in position adjacent seat 218 of vent valve means 210.

Pressurizing drill string 14 thus pressurizes central opening 74, and at a predetermined first pressure, shear pin 212 is sheared which allows downward movement of vent valve means 210. Preferably, the pressure is approximately 300 psi. Vent valve means 210 will move downwardly until it comes to rest against shoulder 222 and vent sleeve 202, and it will be seen that upper and lower seal means 214 and 216 will sealingly isolate vent opening 220 from central opening 74.

The lower end of collet 126, collet connector 190, vent sleeve 202 and bushing 224 may be said to form an inner sleeve means 257 extending through upper plug means 150 to which lower plug means 232 is connected. It will be seen that the pressure in central opening 74 in inner sleeve means 257 is not exerted on inside surface 158 of upper plug means 150 or inside surface 178 of alternate upper plug means 150′. Thus, a means is provided for preventing a bursting pressure from being applied to upper plug means 150, and hard, high strength materials are not required. Accordingly, low strength materials, even including plastic as in the alternate embodiment 150′, may be used in the upper plug means which allows easier drilling as will be described in more detail hereinafter. Finally, it should also be obvious that inner sleeve means 257 also acts as a means for preventing pressure in central opening 74 from being applied to the inside of lower plug means 232 because ball 256 substantially seals against seat 218.

Referring now to FIG. 5, additional pressure may be applied to central opening 74 through drill string 14 such that shear pin 204 is sheared. Thus, vent sleeve 202 is released from collet connector 190 which, of course, releases lower plug means 232 from upper plug means 150 or 150'. Lower plug means 232 in therefore free to travel downwardly through well casing 16 towards float shoe 26. Cement pumped from the surface down through drill string 14 will force lower plug means 232 thus to move downwardly in well casing 16, and wiper rings 248 will wipe the inside surface of well casing 16 free of the drilling mud or other fluids that were already present therein and sealingly separate the mud from the cement above lower plug means 232. Eventually, lower plug means 232 will come to rest against inside, upper surface 258 of float shoe 26. Lower portion 244 of jacket 240 will provide sealing engagement between lower plug means 232 and upper surface 258.

Additional pressure applied through drill string 14 and casing string 16 will be exerted on ball 256 at a level sufficient to shear shear means 230. When this occurs, vent sleeve 202, vent valve means 210 and ball 256 will fall downwardly within lower plug means 232 until stopped by catcher bolt 250. Thus, a valve means is provided whereby a fluid passageway 260 is formed through lower plug means 232, providing fluid communication between well casing 16 above the lower plug means and an inlet opening 262 in float shoe 26. Referring once again to FIG. 1, back pressure valve 34 will be opened by the pressure so that the cement will flow from well casing 16 through lower opening 36 in float shoe 26 and into outer casing annulus 38.

After the desired amount of cement has been pumped through the system, pumping is ceased by the operator. At this point, it is desired to release upper plug means 150 or 150' and pump it downwardly through well casing 16 to displace all of the cement therebelow trough float shoe 26 so that no cement will set within well casing 16.

To release upper plug means 150 or 150', a releasing dart or drill pipe plug 264 is pumped down drill string 14 as shown in FIG. 1.

Releasing dart or drill pipe plug 264 is of a kind known in the art and as designed to sealingly engage the inside surface of drill string 14 and to sealingly close central opening 74 in sub-surface release plug assembly 10. As shown in FIG. 2B, plug 274 engages chamfered shoulder 137 in releasing sleeve 136. Drill string 14 is raised to a predetermined second pressure which is applied above plug 264 causing a downward force on releasing sleeve 136 sufficient to shear shear means 140. Releasing sleeve 136 is forced downwardly until it engages chamfered shoulder 134 in collet 126. In this downwardmost position of releasing sleeve 136, collet fingers 130 and head portions 128 thereof are freed for radially inward movement.

Additional pressure in drill string 14 will then cause head portions 128 of collet fingers 130 to disengage from shoulder 124 in collet retainer 116. Thus, releasing means are provided for releasing upper plug means 150 or 150' for subsequential downward movement through well casing 16.

A similar collet mechanism could be used in attaching lower plug means 232 to upper plug means 150 or 150' rather than the shear means 204 already described. In other words, vent sleeve 202 could be constructed with collet fingers thereon. In this embodiment, vent valve means 210 would also provide sealing of the collet mechanism prior to movement thereof by ball 256. Simultaneously with the release of the collet fingers in this embodiment, vent opening 220 would be closed by vent valve means 210.

Figure 7A:
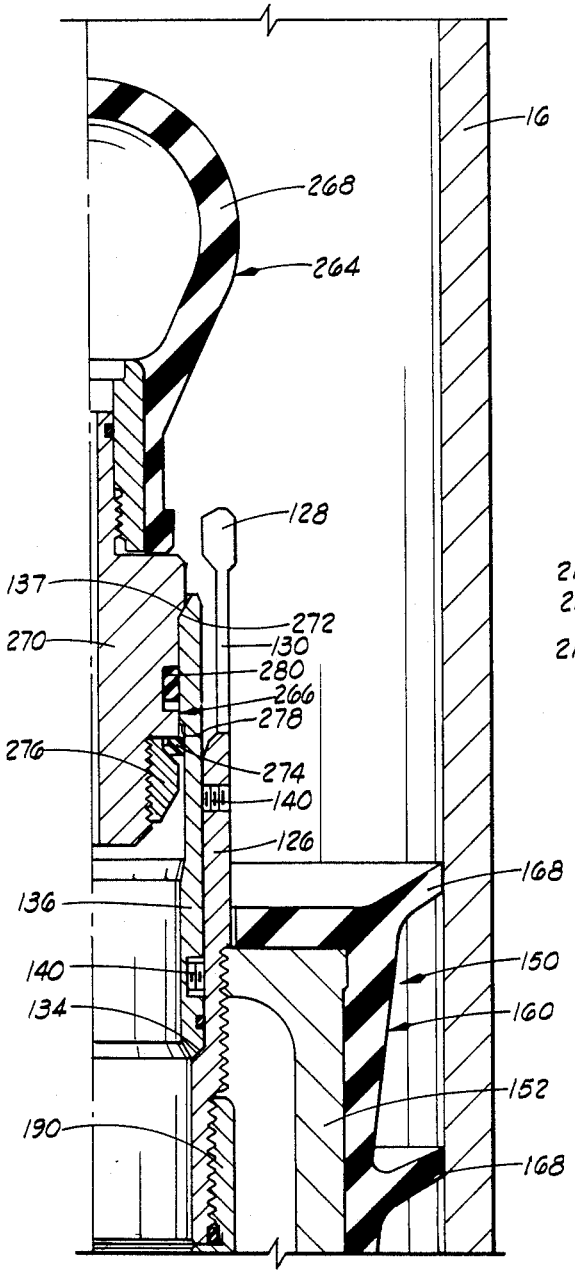
FIGS. 7A and 7B show a longitudinal cross section of the sub-surface release plug assembly after release of the upper plug wherein the top plug is engaged with the bottom plug at the lower end of the well casing.
Figure 7B:
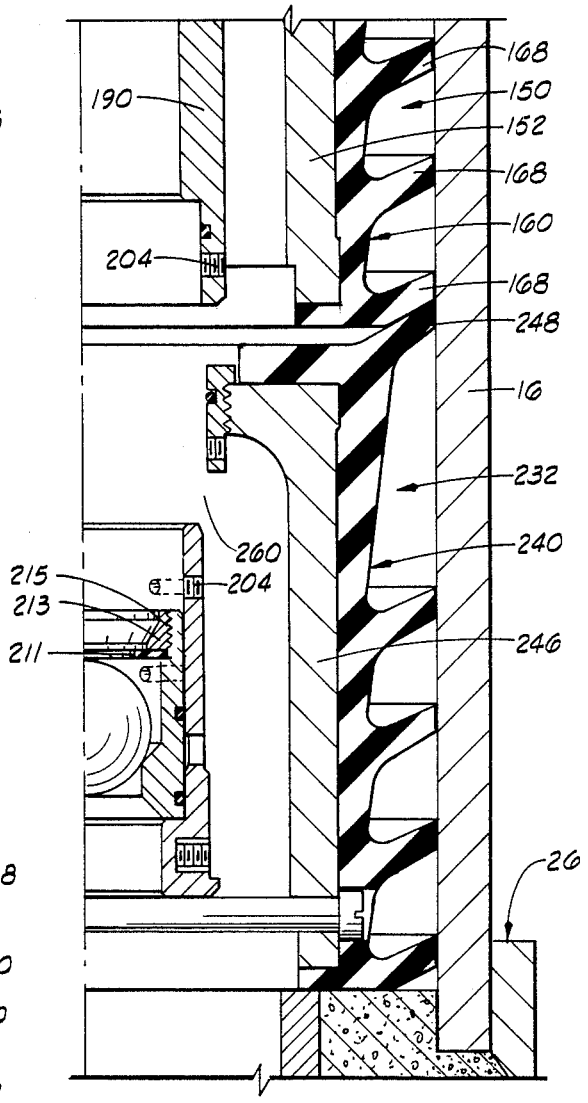

Referring now to FIGS. 7A and 7B, released upper plug means 150 is shown after being moved downwardly through well casing 16 where it is in contact with lower plug means 232. Plug 264 is illustrated with a latching nose 266 connected to an elastomeric body 268. Latching nose 266 includes a mandrel portion 270 having a shoulder 272 thereon which contacts shoulder 137 in releasing sleeve 136. A snap ring 274, disposed between a retainer 276 and mandrel portion 270 is adapted to expand outwardly so that upward movement of plug 264 is prevented by shoulder 278 in releasing sleeve 136. Seal means 280 provides sealing engagement between mandrel portion 270 and releasing sleeve 136. As clearly seen in FIG. 7A, collet fingers 130, and head portions 128 thereof, are completely free.

A releasing dart having wipers rather than a bulbous body 228 could also be used. Such releasing dart would preferably have similar attaching means such as latching nose 266.

As upper plug means 150 or 150' is pumped downwardly through well casing 16, the cement therebelow is displaced outwardly through float shoe 26 into outer casing annulus 38. When upper plug means 150 reaches the lowermost position, the lowermost wiper on jacket 160 thereof sealingly engages the uppermost wiper 248 on jacket 240 of lower plug means 232. Similarly, with alternate upper plug means 150', the lowermost wiper ring 188 would engage the uppermost wiper 248.

After the cement has set, plug 264, upper plug means 150 or 150', and lower plug means 232 are drilled out of casing 16 so that the well can be operated in production. Obviously, because of the construction of sub-surface release plug assembly 10 wherein pressure is not applied to the inner portions of the upper and lower plug means themselves, the correspondingly softer materials of insert 152 in upper plug means 150 and insert 234 of lower plug means 232 facilitate drilling. Plastic insert 170 of alternate upper plug means 150' provides an even greater advantage, although either embodiment is far superior to the hard materials required in the sub-surface release plugs of the prior art.

It can be seen, therefore, that the sub-surface release plug assembly of the present invention is well adapted to carry out the ends and advantages mentioned as well as those inherent therein. While presently preferred embodiments of the invention have been shown for the purposes of this disclosure, numerous changes in the arrangement and construction of parts may be made by those skilled in the art. All such changes are encompassed within the scope and spirit of the appended claims.

What is claimed is:

1. A sub-surface release apparatus for use in a well casing, said apparatus comprising:

upper plug means for connecting to a drill string;

lower plug means for releasably attaching to said upper plug means;

releasing means for releasably connecting said upper plug means to said drill string; and sealing means for totally sealingly separating said releasing means from fluid in said drill string such that said fluid is prevented from contacting any portion of said releasing means prior to releasing said upper plug means.

2. The apparatus of claim 1 further comprising:

releasing means for releasing said lower plug means from said upper plug means in response to a pressure in said drill string; and means for preventing exertion of said pressure on inner portions of said upper and lower plug means.

3. The apparatus of claim 1 wherein said releasing means comprises a collet.

4. The apparatus of claim 1 further comprising second vent means for providing venting between said drill string and said well casing at a position above said upper plug means.

5. The apparatus of claim 4 further comprising check valve means disposed across said second vent means whereby venting is allowed from said well casing to said drill string while preventing venting from said drill string to said well casing.

6. The apparatus of claim 1 further comprising:

a sleeve forming a portion of said releasing means and said sealing means; and wherein, said sealing means further comprises seals disposed above and below said sleeve.

7. The apparatus of claim 4 further comprising a sliding sleeve disposed radially inwardly of said collet.

8. The apparatus of claim 1 further comprising vent means for providing venting between said drill string and said well casing at a position between said upper and lower plug means.

9. A sub-surface release apparatus for use in a well casing, said apparatus comprising:

plug means for sealingly engaging an inner surface of said well casing;

collet releasing means for releasably attaching said plug means to a lower end of a drill string; and sealing means for preventing fluid communication between any portion of said collet releasing means and said drill string prior to releasing said plug means.

10. The apparatus of claim 8 further comprising vent means above said plug means.

11. The apparatus of claim 9 wherein said plug means is a first plug means and further comprising:

second plug means disposed below said first plug means; and releasing means for releasably attaching said second plug means to said plug means.

12. The apparatus of claim 11 further comprising closable vent means disposed between said first and second plug means.

13. The apparatus of claim 11 wherein:

said releasing means for releasably attaching said second plug means to said first plug means may be actuated in response to a first pressure in said drill string; and further comprising means preventing said pressure from being exerted on inner portions of said first and second plug means.

14. The apparatus of claim 8 wherein said sealing means comprises:

a sliding releasing sleeve disposed radially inwardly of said collet releasing means; and seals disposed above and below said collet releasing means sealingly engaging said sleeve;

whereby, downward movement of said releasing sleeve allows said collet releasing means to be disengaged from said drill string.

15. A sub-surface release plug assembly for use in a well casing, said plug assembly comprising:

a top plug releasably connected to a lower end of a drill string;

sealed inner sleeve means extending through said top plug and in communication with said drill string for preventing pressure in said drill string from being communicated to an inner portion of said top plug; and a bottom plug disposed below said top plug and releasably and sealingly connected to said sleeve means such that pressure in said drill string and said sleeve means is prevented from being communicated to an inner portion bottom plug.

16. The plug assembly of claim 15 further comprising:

means for releasing said bottom plug from said top plug so that said bottom plug may be pumped downwardly through said well casing; and means for opening a flow passageway through said bottom plug when said bottom plug reaches a lower end of said well casing.

17. The plug assembly of claim further comprising:

a collet releasing mechanism interconnecting said top plug and said drill string, said collet mechanism having a plurality of collet fingers and a slidable releasing sleeve therein for releasing said collet fingers; and sealing means in operative association with said collet releasing sleeve for totally sealingly separating said collet fingers from said drill string prior to actuation of said collet releasing sleeve.

18. The plug assembly of claim 15 wherein both of said top and bottom plugs each comprises:

an insert; and an elastomeric jacket disposed around said insert, said jacket having a plurality of wipers thereon for sealingly engaging an inner surface of said well casing.

19. The apparatus of claim 17 wherein said sealing means comprises a seal disposed above and below said collet releasing mechanism and sealingly engaged with said releasing sleeve prior to actuation of said collet releasing mechanism.

* * * * *